US006002309A

United States Patent [19]

Nishijima et al.

[11] Patent Number: 6,002,309

[45] Date of Patent: Dec. 14, 1999

[54] DIELECTRIC FILTER

[75] Inventors: Shohachi Nishijima, Komatsu; Hiromi Ogura, Ishikawa-ken, both of Japan

[73] Assignee: Murata Manufacturing Co., Ltd., Japan

[21] Appl. No.: 08/935,467

[22] Filed: Sep. 24, 1997

[30] Foreign Application Priority Data

Sep. 25, 1996 [JP] Japan ..... 8-253155

[51] Int. Cl.[6] ..... H01P 1/205; H01P 5/12

[52] U.S. Cl. ..... 333/206; 333/207; 333/134

[58] Field of Search ..... 333/202, 206, 333/207, 222, 223, 134, 126, 129

[56] References Cited

U.S. PATENT DOCUMENTS

| | | | |
|---|---|---|---|
| 4,733,208 | 3/1988 | Ishikawa et al. | 333/206 X |
| 5,374,906 | 12/1994 | Noguchi et al. | 333/222 X |
| 5,537,082 | 7/1996 | Tada et al. | 333/202 |
| 5,612,654 | 3/1997 | Tsujiguchi et al. | 333/206 X |
| 5,652,555 | 7/1997 | Tada et al. | 333/206 X |

FOREIGN PATENT DOCUMENTS

| | | | |
|---|---|---|---|
| 6-152003 | 3/1986 | Japan . | |
| 4-302502 | 10/1992 | Japan | 333/206 |
| 7-254806 | 10/1995 | Japan . | |
| 9530250 | 11/1995 | WIPO . | |

*Primary Examiner*—Seungsook Ham

*Attorney, Agent, or Firm*—Ostrolenk, Faber, Gerb & Soffen, LLP

[57] ABSTRACT

The invention provides a technique of adjusting the mutual capacitance of resonant through-holes in a dielectric filter while maintaining the shape of input/output electrodes constant without causing a change in the external capacitance. In one such dielectric filter, a plurality of resonant through-holes are formed in a dielectric block, each resonant through-hole including a large-diameter hole and a small-diameter hole, a step being formed at the boundary between the large-diameter hole and the small-diameter hole, the inner wall of each said resonant through-hole being covered with an inner conductor; an outer conductor formed on outer surfaces of said dielectric block except for an end surface in which ends of the respective large-diameter holes are located; and input/output electrodes which are formed on a side face such that said input/output electrodes are coupled with said large-diameter holes; wherein the center axes of said large-diameter holes are deviated from the center axes of the corresponding small-diameter holes, thereby increasing the mutual capacitance between the large-diameter holes.

17 Claims, 13 Drawing Sheets

DIELECTRIC FILTER

BACKGROUND OF THE INVENTION

1. Field of the Invention

The present invention relates to a dielectric filter having a plurality of resonant through-holes formed in a single dielectric block, and more particularly to a dielectric filter having a plurality of resonant through-holes each including a part with a relatively large cross section (hereinafter referred to as a large-diameter hole) and a part with a relatively small cross section (hereinafter referred to as a small-diameter hole).

2. Description of the Related Art

Various techniques to control the characteristics of a dielectric filter for use in communications in a 900 MHZ band have been proposed. For example, International Patent Publication WO 95/30250 discloses a technique in which a receptacle is formed in the upper part of a resonant through-hole so that the receptacle is located near the top surface of a filter body, and furthermore a recess is formed on a side face corresponding to the receptacle. In this technique, the self capacitance and mutual capacitance can be increased by forming the receptacle. On the other hand, the self capacitance can be increased by forming the recess, without causing a significant increase in the mutual capacitance.

In the technique disclosed in Japanese Unexamined Patent Publication 61-52003, a cutout or a slit is formed in an open-circuited side face of a dielectric block. In this technique, the impedance at the open-circuited side face is adjusted by the cutout or the slit formed in the dielectric block to a value different from the impedance at the short-circuited side face so that the resonant through-holes are coupled to a desired degree.

In Japanese Unexamined Patent Publication 7-254806, there is disclosed a technique of producing a dielectric filter in such a manner that each resonant through-hole is divided into a large-diameter part having a greater cross section and a small-diameter part having a smaller cross section so as to achieve a desired degree of coupling between the resonant through-holes. The property of the coupling between resonant through-holes can be varied by shifting the axial position of the small-diameter parts. For example, if the small-diameter parts are moved toward each other, the coupling becomes more inductive, whereas the coupling becomes more capacitive if the small-diameter parts are moved apart from each other. Therefore, it is possible for an attenuation pole to be located at a frequency either lower or higher than the passband so as to achieve a desired frequency characteristic.

However, the technique disclosed in International Patent Publication No. WO 95/30250 has the following disadvantages. The receptacle serves to increase only the self capacitance and mutual capacitance near the open-circuited side face. On the other hand, the recess serves to increase only the self capacitance near the open-circuited side face while the mutual capacitance remains substantially unchanged. When it is desirable to increase the length of the resonant through-holes and also increase the frequency of the attenuation pole, it is required to increase the self capacitance near the open-circuited side face and reduce the mutual capacitance. However, this technique using the receptacle and the recess cannot be employed to meet such the requirement.

The disadvantage of the technique disclosed in Japanese Unexamined Patent Publication 61-52003, in which the coupling between resonant through-holes is adjusted by forming a cutout or a slit in the open-circuited side face, is that the frequency of the attenuation pole cannot be adjusted to a desired value because the mutual capacitance cannot be adjusted by the cutout or the slit although the self capacitance can be adjusted.

In the technique disclosed in Japanese Unexamined Patent Publication 7-254806, when the mutual capacitance is increased in order to locate the attenuation pole at a desired frequency while maintaining the coupling in the same capacitive or inductive modes without changing the general shape of the dielectric block, it is required to increase the diameter of the resonant through-holes at both the open-circuited and short-circuited side faces. However, the increase in the diameter of the resonant through-holes at the open-circuited side face causes an increase in the external coupling capacitance. Therefore, this technique cannot be employed when it is desired to reduce or increase the mutual capacitance without causing a change in the external coupling capacitance.

In view of the above, it is an object of the present invention to provide a dielectric filter whose self capacitance and mutual capacitances can both be easily controlled.

SUMMARY OF THE INVENTION

According to an aspect of the present invention, there is provided a dielectric filter comprising: a plurality of resonant through-holes formed in a dielectric block, each resonant through-hole comprising a large-diameter hole and a small-diameter hole, a step being formed at the boundary between said large-diameter hole and said small-diameter hole, the inner wall of each said resonant through-hole being covered with an inner conductor; an outer conductor formed on the outer surface of said dielectric block except for a surface in which the open ends of the respective large-diameter holes are located; and input/output electrodes located on a surface parallel to a plane in which said resonant through-holes lie, said input/output electrodes being coupled with said large-diameter holes; said dielectric filter being characterized in that the center axes of said large-diameter holes are deviated from the center axes of the corresponding small-diameter holes.

In this structure, the coupling between adjacent resonant through-holes varies depending on the deviation of the large-diameter holes. On the other hand, the distances between the center axes of the large-diameter holes and the input/output electrodes remain unchanged when the axial positions of the large-diameter holes are moved in a direction across the resonant through-holes, because the input/output electrodes are located on the outer surface parallel to the plane in which the resonant through-holes are located. Therefore, it is possible to change the mutual capacitance without causing a significant change in the external coupling capacitance. If the change in the external coupling capacitance cannot be neglected, the change in the external coupling capacitance can be compensated for by moving the axial positions of the large-diameter holes in a direction perpendicular to the plane in which the resonant through-holes lie thereby changing the distances between the input/output electrodes and the large-diameter holes.

According to another aspect of the present invention, there is provided a dielectric filter comprising: a plurality of resonant through-holes formed in a dielectric block, each resonant through-hole comprising a large-diameter hole and a small-diameter hole, a step being formed at the boundary between said large-diameter hole and said small-diameter hole, the inner wall of each said resonant through-hole being covered with an inner conductor; and an outer conductor formed on outer surfaces of said dielectric block except for a surface in which the open ends of the respective resonant through-holes are located; said dielectric filter being characterized in that: a slit is formed on an outer surface parallel to a plane in which said resonant through-holes lie so that said slit is located at a substantially central position between adjacent resonant through-holes; and the inner wall of said slit is covered with a slit conductor connected to said outer conductor.

In this structure, if the depth of the slit is increased, the coupling between the slit conductor and the resonant through-holes increases while the coupling between the resonant through-holes decreases. That is, the self capacitance increases while the mutual capacitance decreases with the increase in the depth of the slit.

In the dielectric filter, the center axes of said large-diameter holes and the center axes of the corresponding small-diameter holes are preferably deviated from each other. With this arrangement, it is possible to adjust the mutual capacitance between the adjacent resonant through-holes separately from that between the large-diameter holes of the resonant through-holes and from that between the small-diameter holes.

Thus it is possible to produce a dielectric filter having desired characteristics in terms of the center frequency, the coupling, the frequency of the attenuation pole, the axial length of the inner conductor, etc., by adjusting the deviation of the large-diameter holes relative to the small-diameter holes, the position of the steps at the boundaries between the small-diameter holes and the large-diameter holes, and the shape of the slit formed on the outer surface of the dielectric block.

Furthermore, the distance from each said step to the open-circuited end face in which the open ends of said resonant through-holes are located is preferably set to a value within a range of 1/16 to 1/4 of the length of each said resonant through-hole. In this arrangement, since the above distance is limited within the range of 1/16 to 1/4 of the length of each said resonant through-hole, it is possible to prevent deformation which would otherwise occur during the production process owing to the small distance between the outer surface and the resonant through-holes. This makes it possible to mass-produce dielectric filters at a reduced cost.

In the case of the dielectric filter having said slit whose end is located in said open-circuited end face, the length of said slit is preferably set to a value within a range of 1/16 to 1/4 of the length of said resonant through-holes. In this arrangement, since the length of the slit is limited within the range of 1/16 to 1/4 of the length of the resonant through-holes, it is possible to prevent deformation which would otherwise occur during the production process owing to the small distance between the slit and the resonant through-holes. This makes it possible to mass-produce dielectric filters at a reduced cost.

In the above dielectric filter, it is preferable that the distance between said open-circuited end face and said steps be substantially equal to the length of said slit. In this arrangement, the slit is formed near the large-diameter holes of the resonant through-holes so as to achieve a highly effective change in the self capacitance or mutual capacitance by means of the slit. That is, a desired change in the self capacitance or mutual capacitance can be achieved simply by forming a rather shallow slit, at an effective location.

The dielectric filter may be formed as a duplexer comprising a transmitting filter and a receiving filter. In this structure, it is possible to easily control the characteristics of the dielectric filter serving as a duplexer. This makes it possible to easily produce a dielectric filter serving as a duplexer.

In the above dielectric filter serving as a duplexer, it is preferable that the distance from said open-circuited end face to said steps in the region of the transmitting filter be different from that in the region of the receiving filter. This makes it possible to control the characteristics of both the transmitting filter and the receiving filter independently of each other.

Furthermore, the slits may be formed so that the length of slits in the region of the transmitting filter is different from the length of slits in the region of the receiving filter. This makes it possible to control the characteristics of both the transmitting filter and the receiving filter independently of each other.

BRIEF DESCRIPTION OF THE DRAWINGS

FIGS. 12A and 12B are longitudinal cross-sectional views illustrating the longitudinal cross sections of respective resonant through-holes formed in the dielectric filter according to the third embodiment of the invention, wherein FIG. 12A illustrates the cross section of a resonant through-hole making up a transmitting filter, and FIG. 12B illustrates the cross section of a resonant through-hole making up a receiving filter;

DETAILED DESCRIPTION OF EMBODIMENTS OF THE INVENTION

The present invention will be described in further detail below with reference to preferred embodiments in conjunction with the accompanying drawings.

Figure 1A:
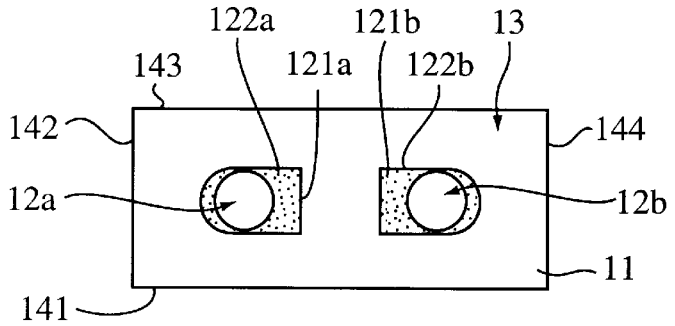
FIG. 1A is a schematic diagram illustrating the structure of a dielectric filter according to a first embodiment of the present invention, seen from its open-circuited end face.
Figure 1B:
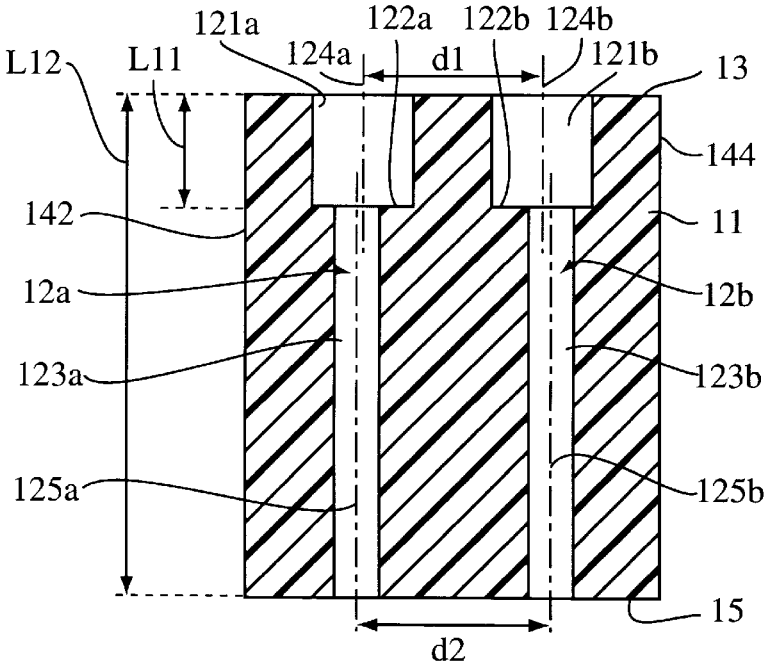
FIG. 1B is a longitudinal cross-sectional view of the dielectric filter.
Figure 1C:
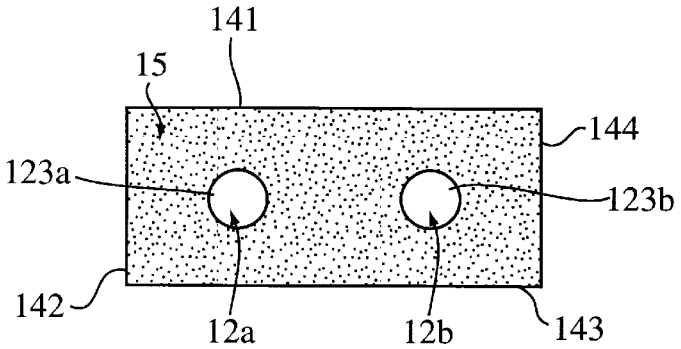
FIG. 1C illustrates the dielectric filter seen from its short-circuited end face.

FIG. 1A is a schematic diagram illustrating the structure of a dielectric filter according to a first embodiment of the present invention, seen from its open-circuited end face, FIG. 1B is a longitudinal cross-sectional view of the dielectric filter, and FIG. 1C illustrates the dielectric filter seen from its short-circuited end face.

The term "center axis" used herein refers to either an axial line extending along the center of a hole having a circular cross section or a line extending through the center of gravity of the cross section of a hole when the shape of its cross section is not circular. In the following description, the term "center axis" is used in the same manner.

In the present embodiment, the resonant through-holes are formed so that they have a circular cross section or a cross section similar to a circle. However, the cross-sectional shape of the resonant through-holes is not limited to those, and an arbitrary shape may be employed. Therefore, the term "large-diameter hole" is used to generally describe a part of a resonant through-hole having a greater cross-sectional area, and the term "small-diameter hole" is used to generally describe a part of a resonant through-hole having a smaller cross-sectional area, wherein the cross-sectional area is changed in a step fashion at the boundary between the small- and large-diameter holes. Although right-angled steps are shown herein, other shapes can be utilized as well.

The terms "upper" and "lower" are used to refer to the directions in the figures only, and not to limit the possible orientations of the dielectric filter in actual use.

As shown in FIGS. 1A–1C, a pair of resonant through-holes 12*a* are 12*b* are formed in a substantially rectangular-shaped dielectric block 11 made up of a dielectric material such as ceramic in such a manner that the resonant through-holes 12*a* and 12*b* extend in a direction parallel to each other. The pair of resonant through-holes 12*a* and 12*b* have structures symmetric to each other wherein each resonant through-hole comprises a large-diameter hole 121*a* or 121*b* and a small-diameter hole 123*a* or 123*b*.

The large-diameter holes 121*a* and 121*b*, which occupy the upper parts of the respective resonant through-holes 12*a* and 12*b*, are generally rectangular in cross section perpendicular to the center axis 124*a* or 124*b* wherein the short side of the rectangular cross section of each large-diameter hole, near the side face 142 or 144, is rounded. The small-diameter holes 123*a* and 123*b*, which occupy the lower parts of the respective resonant through-holes 12*a* and 12*b*, are circular in cross section perpendicular to the center axis 125*a* or 125*b* wherein the diameter of the circular cross section of each small-diameter hole is equal to the length of the short side of the rectangular cross section of each large-diameter hole 121*a* or 121*b*.

The inner walls of the large-diameter holes 121*a* and 121*b*, small-diameter holes 123*a* and 123*b*, and the steps 122*a* and 122*b* at the boundaries between the large-diameter holes 121*a* and 121*b* and the small-diameter holes 123*a* and 123*b*, respectively, are covered with a conductive thin film of silver or copper serving as an inner conductor (represented by thick lines in FIG. 1B). Among the six outer surfaces of the dielectric block 11, the short-circuited end face 15, in which the open ends of the small-diameter holes 123*a* and 123*b* are located, and four side faces 141–144 are covered with a conductive thin film serving as an outer conductor. On the other hand, the end face 13, in which the open ends of the large-diameter holes 121*a* and 121*b* are located, is formed in such a manner as to serve as an open-circuited end face. That is, the end face 13 is covered with no conductive thin film.

The distance d2 between the center axes 125*a* and 125*b* of the respective small-diameter holes 123*a* and 123*b* is determined so that the filter has a desired characteristic. The large-diameter holes 121*a* and 121*b* are located in such a manner that the distance d1 between their center axes 124*a* and 124*b* is smaller than the distance d2 between the center axes 125*a* and 125*b* of the small-diameter holes 123*a* and 123*b* so that the large-diameter holes 121*a* and 121*b* have a sufficiently large mutual capacitance. That is, the center axes 124*a* and 124*b* of the large-diameter holes 121*a* and 121*b* are shifted inward, or in a direction across the resonant through-holes 12*a* and 12*b*, from the center axes 125*a* and 125*b* of the small-diameter holes 123*a* and 123*b*, respectively.

The longitudinal length of each large-diameter hole 121*a*, 121*b*, that is, the distance L11 from the open-circuited end face 13 to the step 122*a* or 122*b*, is preferably set to a value within a range of 1/16 to 1/4 of the axial length L12 of the resonant through-holes 12*a* and 12*b* taking into account the ease of production of the dielectric block 11 and also the change in the frequency characteristics relative to the deviation of the large-diameter holes 121*a* and 121*b*. In this specific embodiment, the distance L11 is set to 1/4 of the length L12.

Figure 2:
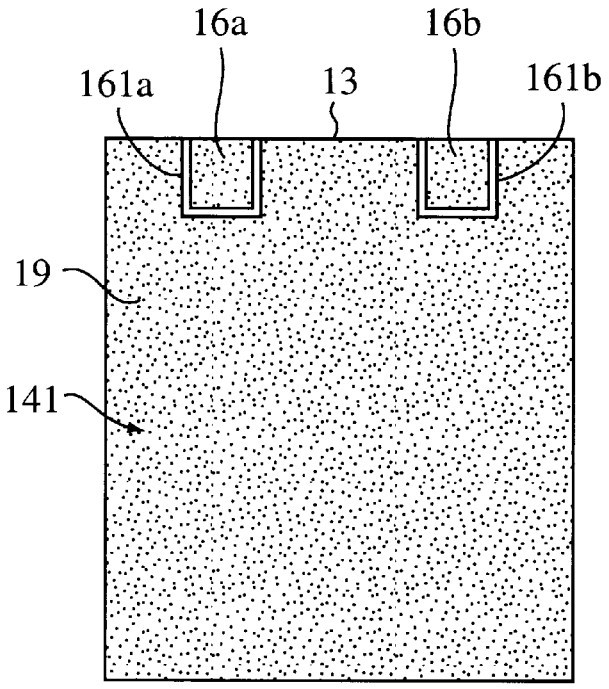
FIG. 2 is a schematic diagram illustrating the structures of input/output electrodes formed on a side face of the dielectric block according to the first embodiment of the invention.

FIG. 2 is a schematic diagram illustrating the structures of input/output electrodes formed on a side face 141 of the dielectric block 11.

The side face 141 of the dielectric block 11 serves as a mounting plane. That is, the dielectric block 11 is mounted on a circuit board such that the side face 141 is in contact with the circuit board. Rectangular-shaped input/output electrodes 16*a* and 16*b* are formed on the side face 141 serving as the mounting plane at locations which correspond to the respective large-diameter holes 121*a* and 121*b* and which are near the open-circuited end face 13, such that the input/output electrodes 16*a* and 16*b* are isolated from the output conductor 19 by insulating regions 161*a* and 161*b* surrounding the input/output electrodes 16*a* and 16*b* and such that the input/output electrodes 16*a* and 16*b* are capacitively coupled with the large-diameter holes 121*a* and 121*b*, respectively.

Figure 3:
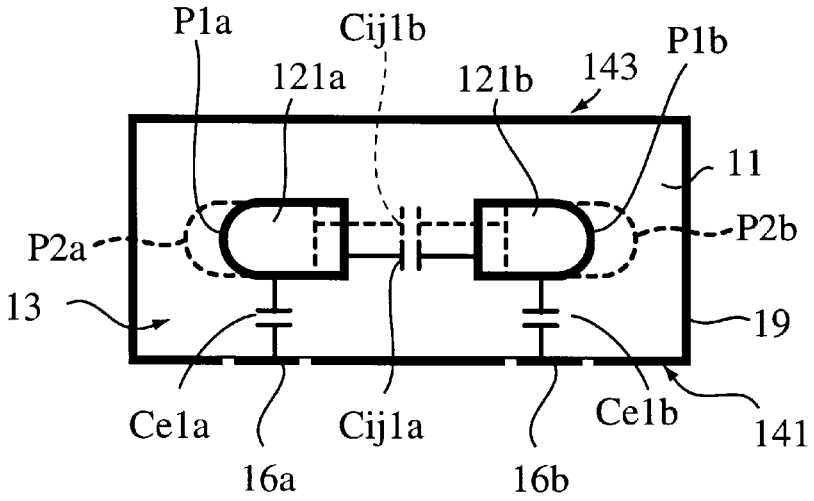
FIG. 3 is a schematic diagram illustrating the external capacitance and the mutual capacitance associated with large-diameter holes in the dielectric filter according to the first embodiment of the present invention.

FIG. 3 illustrates the external capacitance and the mutual capacitance. Referring to this figure, the effects of the deviation of the large-diameter holes 121*a* and 121*b* will be described below.

In FIG. 3, the large-diameter holes 121*a* and 121*b* of the present embodiment are located at positions denoted by solid lines P1*a* and P1*b*, while broken lines P2*a* and P2*b* represent positions at which the large-diameter holes 121*a* and 121*b* will be located when the distance between the large-diameter holes 121*a* and 121*b* is increased. If the mutual capacitance between the large-diameter holes 121*a* and 121*b* is denoted by $C_{ij}$1*a* for the locations P1*a* and P1*b*, and by $C_{ij}$1*b* for the locations P2*a* and P2*b*, then $C_{ij}1a>C_{ij}1b$.

In the above-described deviation of the center axes 124*a* and 124*b*, the large-diameter holes 121*a* and 121*b* are moved in a direction parallel to the plane of the side face 141 in which the input/output electrodes 16*a* and 16*b* are located. Therefore, the distances from the input/output electrodes 16*a* and 16*b* to the large-diameter holes 121*a* and 121*b*, respectively, are maintained substantially constant when the large-diameter holes 121*a* and 121*b* are moved. Thus, the external coupling capacitance $C_e$1*a* of the large-diameter holes 121*a* and 121*b* located at the positions P1*a* and P1*b* is substantially equal to the external coupling capacitance $C_e$1*b* of the large-diameter holes 121*a* and 121*b* located at the positions P2*a* and P2*b*.

In other words, if the large-diameter holes 121*a* and 121*b* are moved by an amount within a certain range in the direction parallel to the side face 141 (or in the direction across the resonant through-holes 12*a* and 12*b*), only the mutual capacitance $C_{ij}$1 varies while the external coupling capacitance $C_e$1*a* or $C_e$1*b* remains unchanged.

Figure 4:
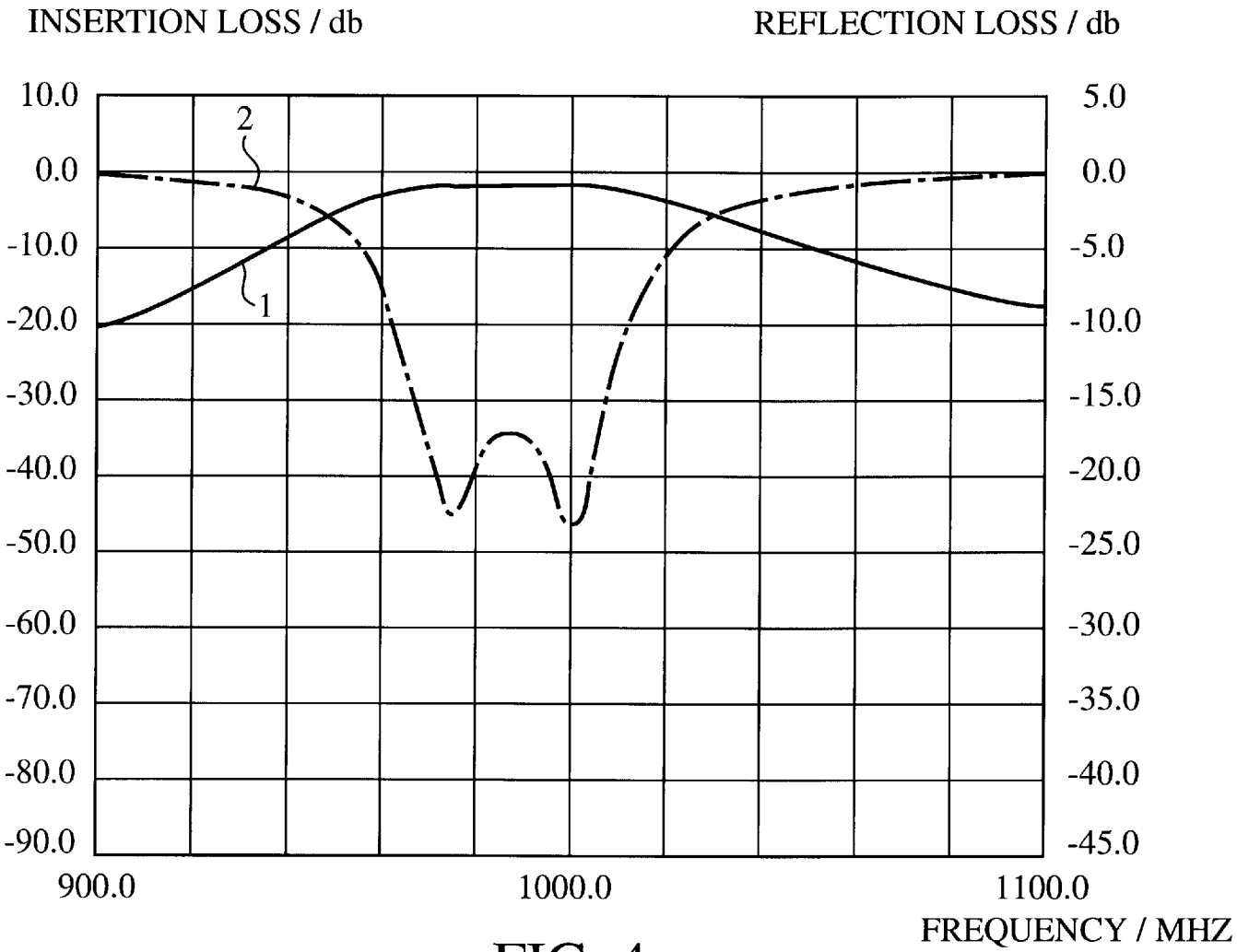
FIG. 4 is a graph illustrating the reflection loss and the insertion loss versus frequency characteristic of the dielectric filter according to the first embodiment of the invention, for the case where the distance between the large-diameter holes is reduced.
Figure 5:
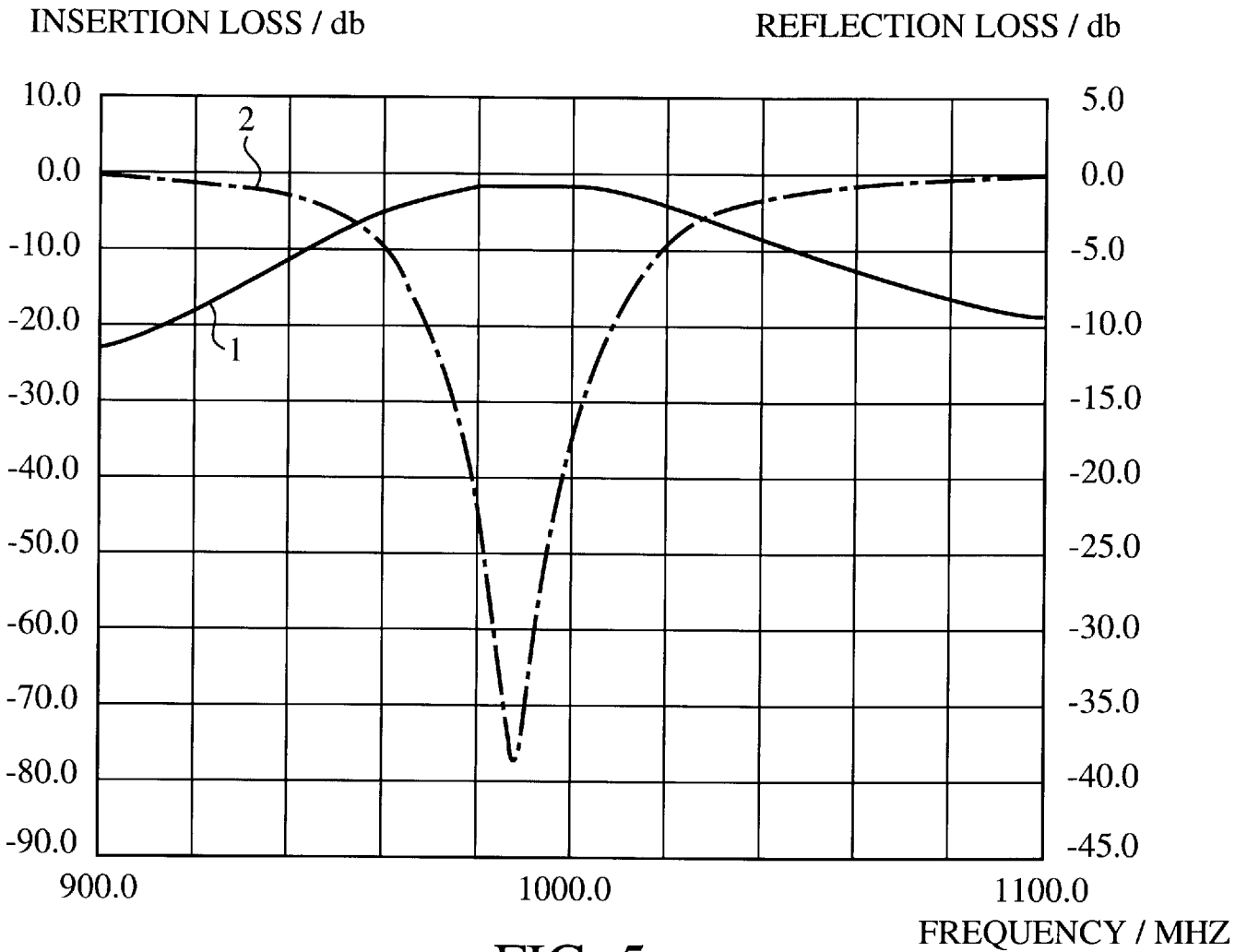
FIG. 5 is a graph illustrating the reflection loss and the insertion loss versus frequency characteristic of the dielectric filter according to the first embodiment of the invention, for the case where the distance between the large-diameter holes is increased.

FIG. 4 illustrates the reflection loss (1) and the insertion loss (2) as a function of frequency for the case where the large-diameter holes 121*a* and 121*b* are located at the positions P1*a* and P1*b*. FIG. 5 illustrates the reflection loss (1) and the insertion loss (2) as a function of frequency for the case where the large-diameter holes 121*a* and 121*b* are located at the positions P2*a* and P2*b*. If the distance d1 between the large-diameter holes 121*a* and 121*b* is reduced, the mutual capacitance $C_{ij}$1 between the large-diameter holes 121*a* and 121*b* increases and thus the capacitive coupling between the large-diameter holes 121*a* and 121*b* becomes strong. As a result, the filter has a wide passband (refer to FIG. 4). On the other hand, if the distance d1 between the large-diameter holes 121*a* and 121*b* is increased, the mutual capacitance $C_{ij}$1 between the large-diameter holes 121*a* and 121*b* decreases, and thus the capacitive coupling between the large-diameter holes 121*a* and 121*b* becomes weak. As a result, the filter has a narrow passband (refer to FIG. 5).

As described above, when the mutual capacitance $C_{ij}$1 between the large-diameter holes 121*a* and 121*b* is varied by varying the deviation of the center axes 124*a* and 124*b* of the large-internal-diameter holes 121*a* and 121*b*, the external coupling capacitance $C_e$1*a* or $C_e$1*b* is maintained substantially constant. This means that it is possible to vary the mutual coupling $C_{ij}$1 without having to make a correction in terms of the external coupling capacitance $C_e$1*a* or $C_e$1*b*. Therefore, it is not required to change the shape of the input/output electrodes 16 to correct the external coupling capacitance $C_e$1*a* or $C_e$1*b*. Thus, when prototypes of bandpass filters are produced to determine the final structure of the filter having a desired bandpass characteristic, it is required to consider only the amount of movement of the large-diameter holes 121*a* and 121*b*, and the change in the external coupling capacitance $C_e$1*a* or $C_e$1*b* is not required to be taken into account. This makes it easy to perform the production of prototypes of filters.

Figure 6A:
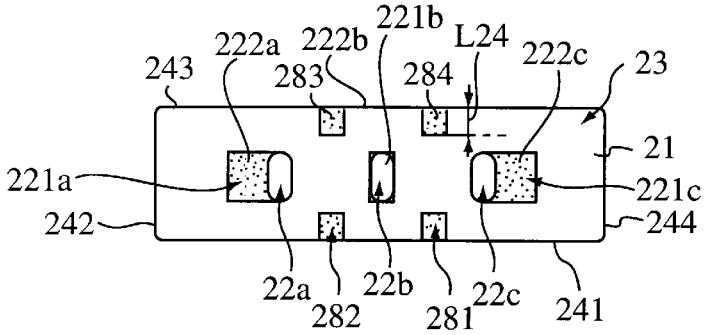
FIG. 6A is a schematic diagram illustrating the structure of a dielectric filter according to a second embodiment of the present invention, seen from its open-circuited end face.
Figure 6B:
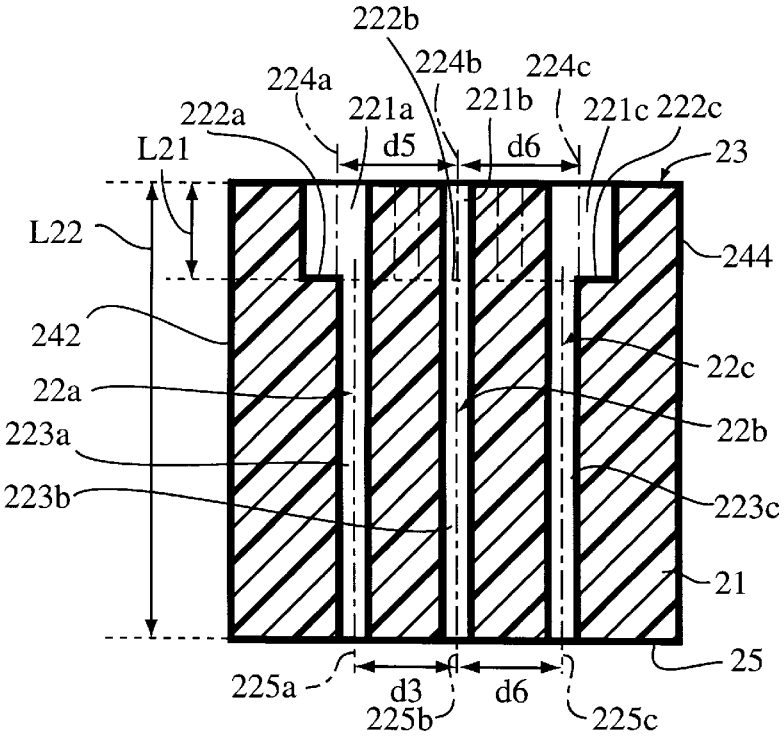
FIG. 6B is a longitudinal cross-sectional view of the dielectric filter.
Figure 6C:
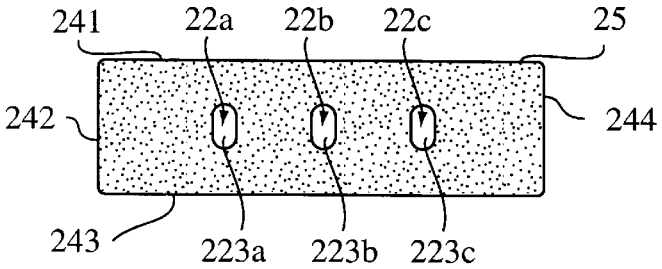
FIG. 6C illustrates the dielectric filter seen from its short-circuited end face.

FIG. 6A is a schematic diagram illustrating the structure of a dielectric filter according to a second embodiment of the present invention, seen from its open-circuited end face, FIG. 6B is a longitudinal cross-sectional view of the dielectric filter, and FIG. 6C illustrates the dielectric filter seen from its short-circuited end face.

Three resonant through-holes 22*a*–22*c* are formed in a generally rectangular-shaped dielectric block 21 made up of a dielectric material such as ceramic. Of these three resonant through-holes 22*a*–22*c*, the resonance through-holes 22*a* and 22*c* are formed into shapes symmetric to each other. Each resonant through-hole 22*a*–22*c* comprises a large-diameter hole 221*a*, 221*b* or 221*c*, and a small-diameter hole 223*a*, 223*b*, or 223*c*.

The large-diameter holes 221*a* and 221*c*, which occupy the upper parts of the respective resonant through-holes 22*a* and 22*c*, are generally rectangular in cross section perpendicular to the center axis 224*a* or 224*c* wherein one of the short sides of the rectangular cross section of each large-diameter hole is rounded. The large-diameter hole 221*b* is rectangular in cross section perpendicular to the center axis 224*b*. The small-diameter holes 223*a* and 223*c*, which occupy the lower parts of the respective resonant through-holes 22*a* and 22*c*, are generally elliptic in cross section perpendicular to the center axis 225*a* or 225*c*.

The inner walls of the large-diameter holes 221*a*–221*c*, small-diameter holes 223*a*–223*c*, and the steps 222*a*–222*c* at the boundaries between the respective large-diameter holes 221*a*–221*c* and the small-diameter holes 223*a*–223*c* are covered with a conductive thin film serving as an inner conductor. Among the six outer surfaces of the dielectric block 21, the short-circuited end face 25, in which the open ends of the small-diameter holes 223*a*–223*c* are located, and four side faces 241–244 are covered with a conductive thin film serving as an outer conductor. On the other hand, the end face 23, in which the open ends of the large-diameter holes 221*a*–221*c* are located, is formed such that it serves as an open-circuited end face. That is, the end face 23 is covered with no conductive thin film.

The respective small-diameter holes are located so that the distance d3 between the small-diameter hole 223*a* and the small-diameter hole 223*b* is equal to the distance d4 between the small-diameter hole 223*b* and the small-diameter hole 223*c*. The respective large-diameter holes are located so that the distance d5 between the large-diameter hole 221*a* and the large-diameter hole 221*b* is equal to the distance d6 between the large-diameter hole 221*b* and the large-diameter hole 221*c*.

To reduce the mutual capacitance between the large-diameter holes 221*a* and 221*b*, the center axis 224*a* of the large-diameter hole 221*a* is deviated toward the side face 242 as much as possible within a range in which the large-diameter hole 221*a* can be moved. Similarly, to reduce the mutual capacitance between the large-diameter holes 221*b* and 221*c*, the center axis 224*c* of the large-diameter hole 221*c* is deviated toward the side face 244 as much as possible within a range in which the large-diameter hole 221*c* can be moved.

As a result, the center axis 224*a* of the large-diameter hole 221*a* is deviated toward the side face 242 relative to the center axis 225*a* of the small-diameter hole 223*a* extending continuously from the large-diameter hole 221*a*. Similarly, the center axis 224*c* of the large-diameter hole 221*c* is deviated toward the side face 244 relative to the center axis 225*c* of the small-diameter hole 223*c* extending continuously from the large-diameter hole 221*c*.

Furthermore, to further reduce the mutual capacitance between the large-diameter hole 221*a* and the large-diameter hole 221*b* and also the mutual capacitance between the large-diameter hole 221*b* and the large-diameter hole 221*c*, the transverse width of the large-diameter hole 221*b* measured in the transverse direction of the resonant through-holes 22*a*–22*c* is reduced as much as possible. That is, the transverse width of the large-diameter hole 221*b* measured in the transverse direction of the resonant though-holes 22*a*–22*c* is set to a value equal to the transverse width of the small-diameter hole 223*b* measured in the same direction. In the resonant through-hole 22*b*, the large-diameter hole 221*b* and the small-diameter hole 223*b* are coaxial, that is, their center axes lie on the same line.

Slits 281–284 are formed in the respective side faces 241 and 243 parallel to the plane in which the axes of the resonant through-holes 22*a*–22*c* lie in such a manner that the slits 281–284 extend in a direction parallel to the axes of the resonant through-holes 22*a*–22*c* and in such a manner that the slits 282 and 283 are located respectively at substantially central positions between the resonant through-holes 22*a* and 22*b* while the slits 281 and 284 are located respectively at substantially central positions between the resonant through-holes 22*b* and 22*c*. The inner walls of the respective slits 281–284 are covered with a slit conductor connected to the outer conductor disposed on the side faces 241 and 243. If the depth L24 of the slits 281–284 is too shallow, it is impossible to obtain sufficiently the effects of the invention. Conversely, if the depth L24 is too great, cracking tends to occur during the production process. Taking into account the above, in the present embodiment, the depth L24 of each slit 281–284 is set to a value nearly equal to ¼ of the length of the short sides of the open-circuited end face 23.

The distance between the open-circuited end face 23 and each step 222*a*–222*c* is equally set to L21. The distance L21 is preferably set to a value within a range of 1/16 to ¼ of the axial length L22 of the resonant through-holes 22*a*–22*c* taking into account the ease of production of the dielectric block 21 and also the change in the characteristics relative to the deviation of the large-diameter holes 221*a*–221*c*. In this specific embodiment, the distance L21 is set to ¼ of the length L22.

Figure 7:
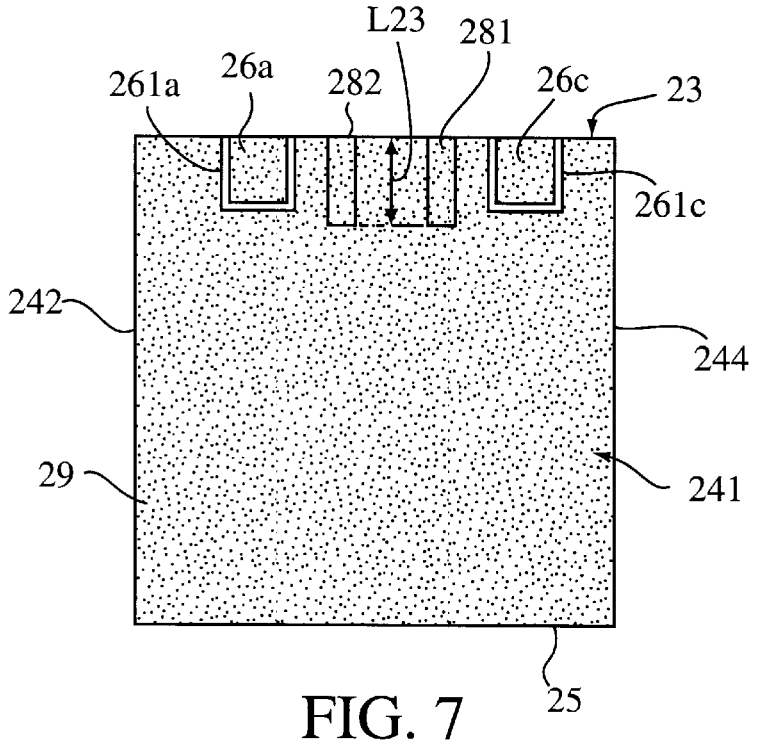
FIG. 7 is a schematic diagram illustrating the structures of input/output electrodes formed on a side face of the dielectric block according to the second embodiment of the invention.

FIG. 7 is a schematic diagram illustrating the structure of the input/output electrodes and the slits formed on the side face 242 of the dielectric block 21.

The side face 241 of the dielectric block 21 serves as a mounting plane. That is, the dielectric block 21 is mounted on a circuit board such that the side face 241 is in contact with the circuit board. Rectangular-shaped input/output electrodes 26*a* and 26*c* are formed on the side face 241 serving as the mounting plane, at locations which correspond to the respective large-diameter holes 221*a* and 221*c* and which are near the open-circuited end face 23, such that the input/output electrodes 26*a* and 26*c* are isolated from the output conductor 29 by insulating regions 261*a* and 261*c* surrounding the input/output electrodes 26*a* and 26*c* and such that the input/output electrodes 26*a* and 26*c* are capacitively coupled with the large-diameter holes 221*a* and 221*c*, respectively.

The length of each slit 281, 282 formed on the side face 241 is equally set to L23 (the length of each slit 283, 284 is also set to L23). Those parts of the slits 281–284 corresponding to the large-diameter holes 221*a*–221*c* have greater effects than other parts. Thus, to achieve the highest possible effects of the slits 281–284 and for ease of design, the length L23 of each slit 281–284 of the present embodiment is set to a value equal to the length L21 of the large-diameter holes 221*a*–221*c* (the distance between the open-circuited end face 23 and the steps 222*a*–222*c*).

Figure 8:
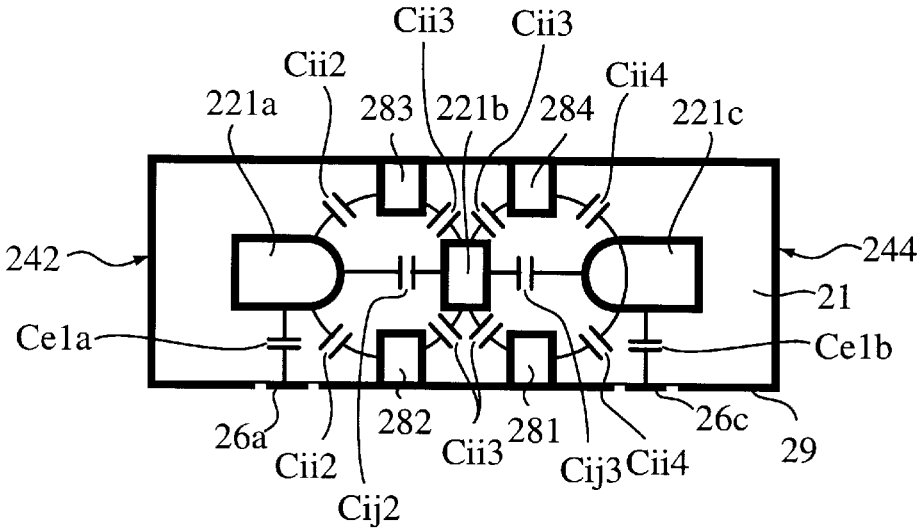
FIG. 8 is a schematic diagram illustrating the external capacitance and the mutual capacitance associated with large-diameter holes in the dielectric filter according to the second embodiment of the present invention.

FIG. 8 illustrates the self capacitance and the mutual capacitance of the large-diameter holes 221*a*–221*c*. Referring to this figure, the effects of the large-diameter holes 221*a*–221*c* and the slits 281–284 will be described below.

The center axis 224*a* of the large-diameter hole 221*a* is deviated toward the side face 242 as much as possible. Similarly, the center axis 224*c* of the large-diameter hole 221*c* is deviated toward the side face 244 as much as possible. The length of the large-diameter hole 221*b* seen in a direction parallel to the side face 241 is minimized. That is, the distance between the large-diameter hole 221*a* and the large-diameter hole 221*b* and also the distance between the large-diameter hole 221*b* and the large-diameter hole 221*c* are maximized so that the mutual capacitances $C_{ij}$2 and $C_{ij}$3 are minimized.

As in the first embodiment described above, when the center axes 224*a* and 224*c* are deviated, substantially no change occurs in the external capacitances $C_e$1*a* and $C_e$1*b* between the large-diameter holes 221*a*, 221*c* and the input/output electrodes 26*a*, 26*c*.

In this embodiment, the slits 281–284 serve to reduce the coupling capacitance between the large-diameter hole 221*a* and the large-diameter hole 221*b* and also the coupling capacitance between the large-diameter hole 221*b* and the large-diameter hole 221*c*. Therefore, the mutual capacitances $C_{ij}$2 and $C_{ij}$3 are further reduced to lower levels than can be obtained when no slits 281–284 are formed. In other words, The coupling between the resonant through-hole 22*a* and the resonant through-hole 22*b* and also the coupling between the resonant through-hole 22*b* and the resonant through-hole 22*c* become more inductive than would be in the structure having no slits 281–284.

Furthermore, the slit conductor covering the inner wall of each slit 281–284 and connected to the outer conductor causes an increase in the coupling between the large-diameter holes 221*a*–221*c* and the outer conductor. Thus, the self capacitances $C_{ii}$2–$C_{ii}$4 of the large-diameter holes 221*a*–221*c* are increased by the slits 281–284. As a result, the resonance frequency decreases.

In other words, if the resonance frequency is maintained constant, the axial length L22 of each resonant through-hole 22*a*–22*c* can be reduced, that is, it is possible to reduce the size of the dielectric block 21.

Figure 9:
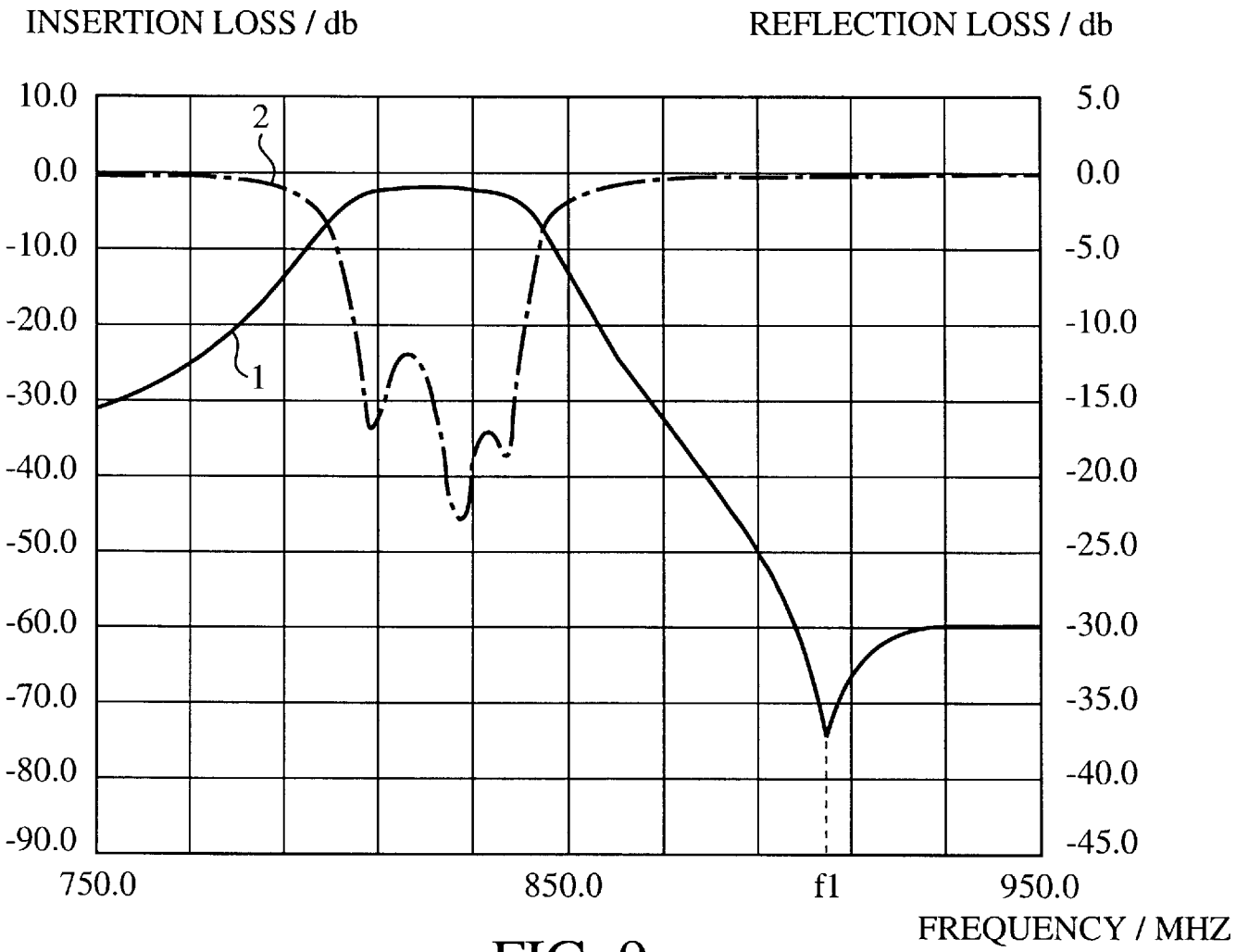
FIG. 9 is a graph illustrating the reflection loss and the insertion loss versus frequency characteristic of the dielectric filter according to the second embodiment of the invention.

FIG. 9 illustrates the insertion and reflection losses versus frequency characteristics of the dielectric filter of the second embodiment.

In the present embodiment, since the resonant through-holes 22*a*–22*c* are inductively coupled with each other, the attenuation pole of the insertion loss (1) appears at a frequency f1 higher than the passband, as shown in FIG. 9.

The frequency of the attenuation pole can be varied by adjusting the degree of the inductive coupling among the resonant through-holes 22*a*–22*c*.

Figure 10:
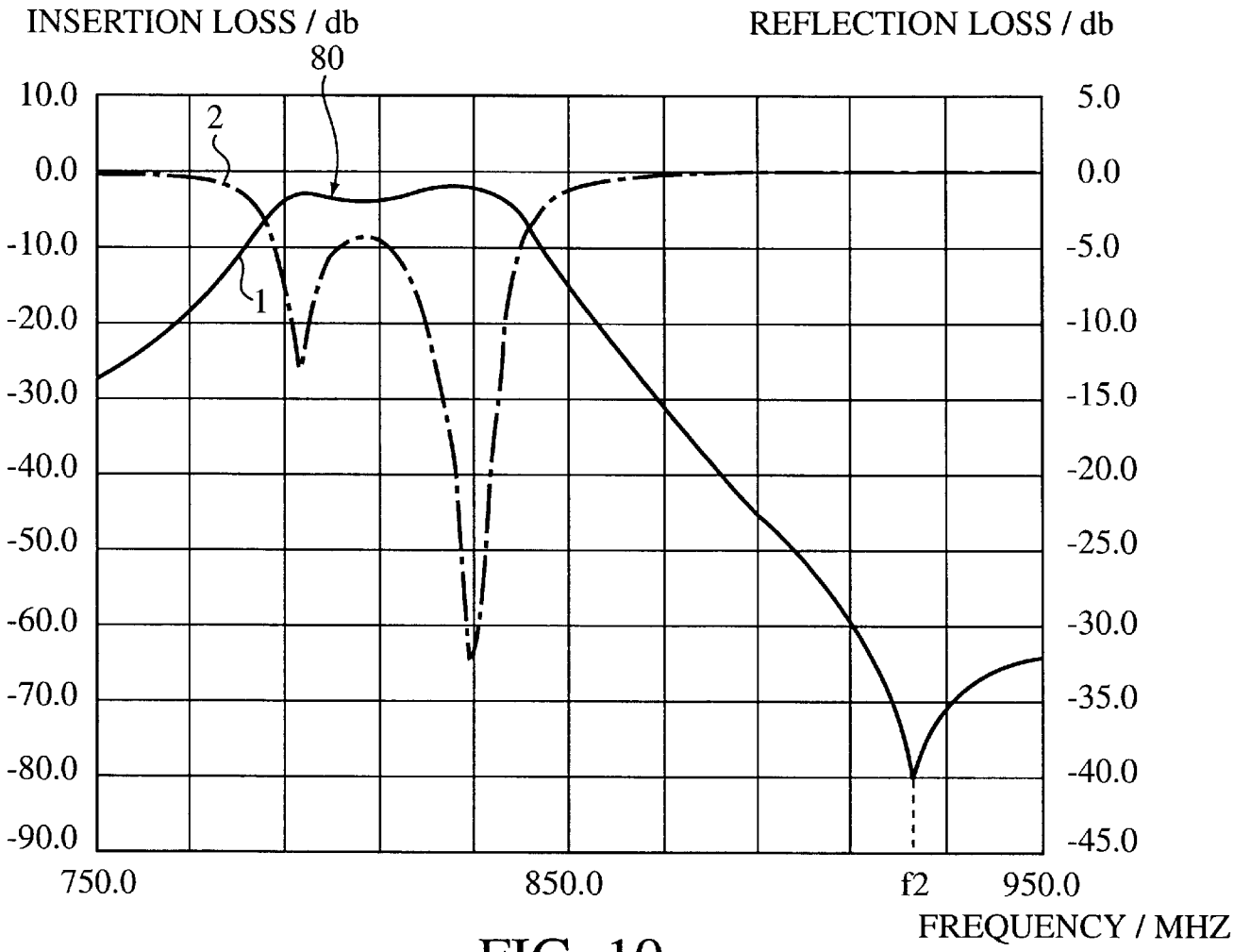
FIG. 10 is a graph illustrating the reflection loss and the insertion loss versus frequency characteristic of a dielectric filter having a slit deeper than the slit employed in the second embodiment.

FIG. 10 illustrates the insertion and reflection losses versus frequency characteristics which can be obtained when the depth of the slits 281–284 is increased from the value employed in the second embodiment described above. In this example, the depth of the slits 281–284 is increased by about 20% relative to that employed in the second embodiment. As a result, the inductive coupling among the resonant through-holes 22*a*–22*c* becomes strong (while the mutual capacitances $C_{ij}$2 and $C_{ij}$3 decrease) compared with that obtained in the second embodiment, and thus the frequency of the attenuation pole shifts from f1 to a higher frequency f2.

The increased depth of the slits 281–284 results in an increase in the self capacitances $C_{ii}$2–$C_{ii}$4, and thus the resonance frequency shifts to a lower value. As a result, the passband expands toward lower frequencies (as represented by 80 in FIG. 10). If the length L22 is properly adjusted, it is possible to obtain a passband similar to that obtained in the first embodiment.

Figure 11A:
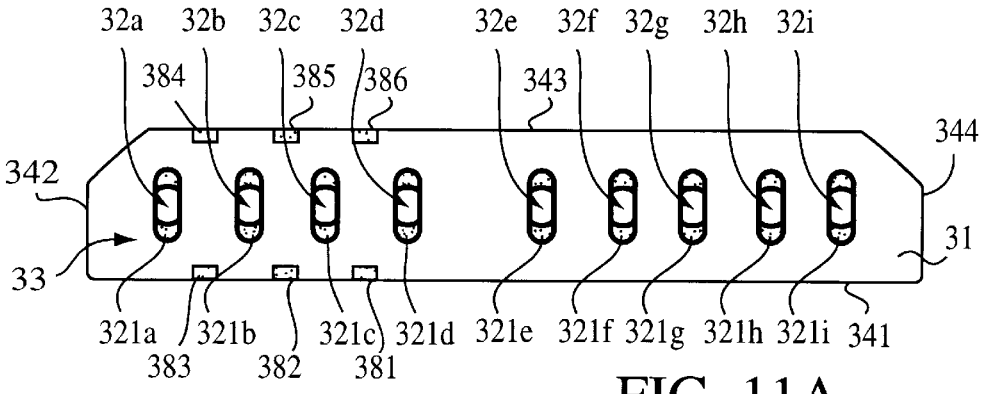
FIG. 11A is a schematic diagram illustrating the structure of a dielectric filter according to a third embodiment of the present invention, seen from its open-circuited end face.
Figure 11B:
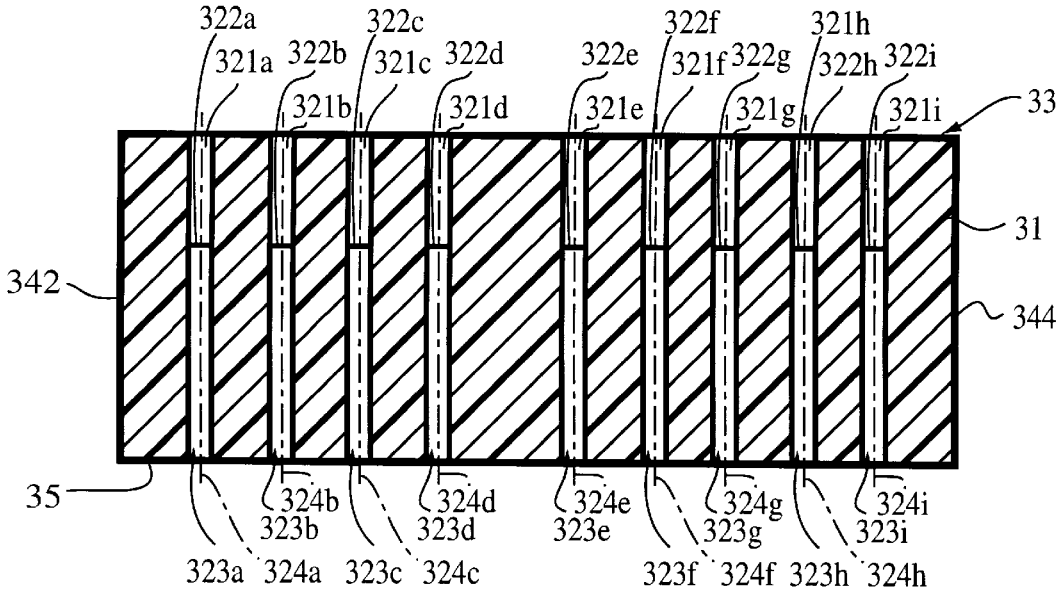
FIG. 11B is a longitudinal cross-sectional view of the dielectric filter.
Figure 11C:
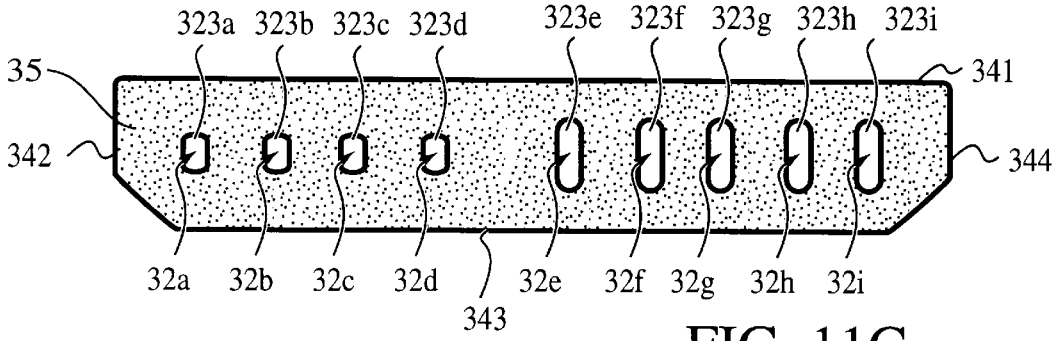
FIG. 11*c* illustrates the dielectric filter seen from its short-circuited end face.
Figure 12A:
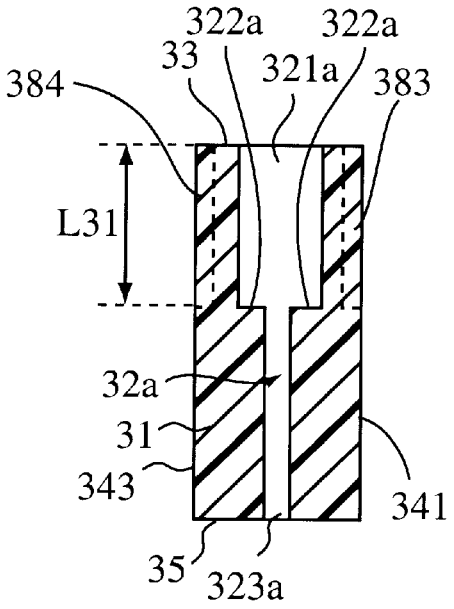
Figure 12B:
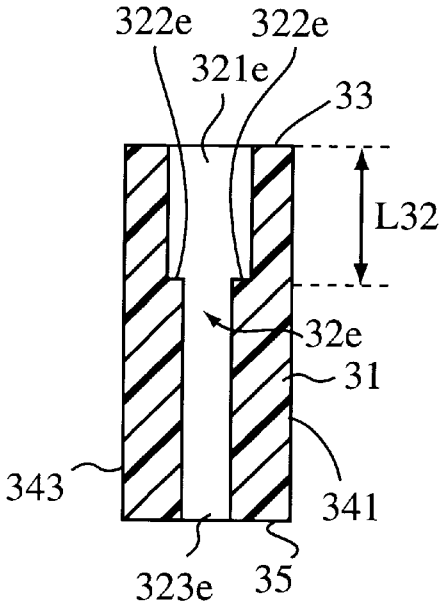

FIG. 11A is a schematic diagram illustrating the structure of a dielectric filter according to a third embodiment of the present invention, seen from its open-circuited end face, FIG. 11B is a longitudinal cross-sectional view of the dielectric filter, and FIG. 11C illustrates the dielectric filter seen from its short-circuited end face. FIG. 12A is a longitudinal cross-sectional view illustrating the longitudinal cross sections of resonant through-holes of the dielectric filter making up a transmitting filter, and FIG. 12B illustrates the cross sections of resonant through-holes making up a receiving filter.

Nine resonant through-holes 32*a*–32*i* are formed in a generally rectangular-shaped dielectric block 31 made up of a dielectric material such as ceramic. Each resonant through-hole 32*a*–32*i* comprises a large-diameter hole 321*a*–321*i* and a small-diameter hole 323*a*–323*i*. The center axes of the large-diameter holes 321*a* and those of the corresponding small-diameter holes 323*i* are coaxial as represented by center axes 324*a*–324*i* in FIG. 11. Of the nine resonant through-holes 32*a*–32*i*, resonant through-holes 32*a*–32*d* are equal in structure to one another and make up the transmitting filter, while resonant through-holes 32*e*–32*i* are equal in structure to one another and make up the receiving filter.

The large-diameter holes 321*a*–321*i* which occupy the upper parts of the respective resonant through-holes 32*a*–32*i*, and also the small-diameter holes 323*a*–323*i* which occupy the lower parts of the respective resonant through-holes 32*a*–32*i*, are generally rectangular in cross section perpendicular to the center axes 324*a*–324*i* wherein both the short sides of each cross section are rounded. The length in a direction perpendicular to the plane in which the resonant through-holes 32*a*–32*i* lie is greatest in the large-diameter holes 321*a*–321*i*, moderate in the small-diameter holes 323*e*–323*i*, and smallest in the small-diameter holes 323*a*–323*d*.

The inner walls of the large-diameter holes 321*a*–321*i*, small-diameter holes 323*a*–323*i*, and the steps 322*a*–322*c* at the boundaries between the respective large-diameter holes 321*a*–321*i* and the small-diameter holes 323*a*–323*i* are covered with a conductive thin film serving as an inner conductor. Among the six outer surfaces of the dielectric block 31, the short-circuited end face 35, in which the open ends of the small-diameter holes 323*a*–323*i* are located, and four side faces 341–344 are covered with a conductive thin film serving as an outer conductor. On the other hand, the end face 33, in which the open ends of the large-diameter holes 321*a*–321*i* are located, is formed such that it serves as an open-circuited end face. That is, the end face 33 is covered with no conductive thin film.

In the present embodiment, as described above, the center axes of the large-diameter holes 321*a*–321*i* are coaxial with the center axes of the small-diameter holes 323*a*–323*i*. However, in a case where the size of the large-diameter holes 321*a*–321*i* is increased, as seen in the direction across the resonant through-holes 32*a*–32*i* from one to another, the center axes of the large-diameter holes 321*a*–321*i* may be shifted from the center axes of the small-diameter holes 323*a*–323*i*.

In the four resonant through-holes 32*a*–32*d* making up the transmitting filter, the distance between the open-circuited end face 33 to the steps 322*a*–322*d* is set to L31. On the other hand, in the four resonant through-holes 32*e*–32*i* making up the receiving filter, the distance between the open-circuited end face 33 to the steps 322*e*–322*i* is set to L32. That is, the axial length of the large-diameter holes 321*a*–321*d* of the resonant through-holes 32*a*–32*d* making up the transmitting filter is different from that of the large-diameter holes 321*e*–321*i* of the resonant through-holes 32*e*–32*i* making up the receiving filter. This is because the transmitting and receiving filters are required to have different filter characteristics and thus it is required that their structure should be optimized for the required characteristics.

Slits 381–386 are formed in the respective side faces 341 and 343 parallel to the plane in which the axes of the resonant through-holes 32*a*–32*i* lie in such a manner that the slits 381–386 extend in a direction parallel to the axes of the resonant through-holes 32*a*–32*d* and in such a manner that the slits 381–386 are located at substantially central respective positions between the respective adjacent resonant through-holes 32*a* and 23*b*, 32*b* and 32*c*, and 32*c* and 32*d*. The inner walls of the respective slits 381–386 are covered with a slit conductor connected to the outer conductor disposed on the side faces 341 and 343. All these slits 381–386 have an equal length. To achieve the highest possible effects of the slits 281–284, the length of each slit 381–386 is set to a value equal to the length L31 of the large-diameter holes 321*a*–321*d*.

In the present embodiment, the slits 381–386 are formed at such locations which cause a reduction in the coupling among the large-diameter holes 321*a*–321*d*, whereas no slits are formed which would cause a reduction in the coupling among the large-diameter holes 321*e*–321*i*, because the resonant through-holes 32*a*–32*d* in the transmitting filter are required to be inductively coupled with each other while the resonant through-holes 32*e*–32*i* in the receiving filter are required to be capacitively coupled with each other.

Although not shown in FIGS. 11A–11C, there are also provided input/output electrodes for being connected to an antenna and capacitively coupled with the large-diameter holes 321*d* and 321*e*, an input/output electrode for being connected to a transmitter and capacitively coupled with the large-diameter hole 321*a*, and an input/output electrode for being connected to a receiver and capacitively coupled with the large-diameter hole 321*i*.

Figure 13:
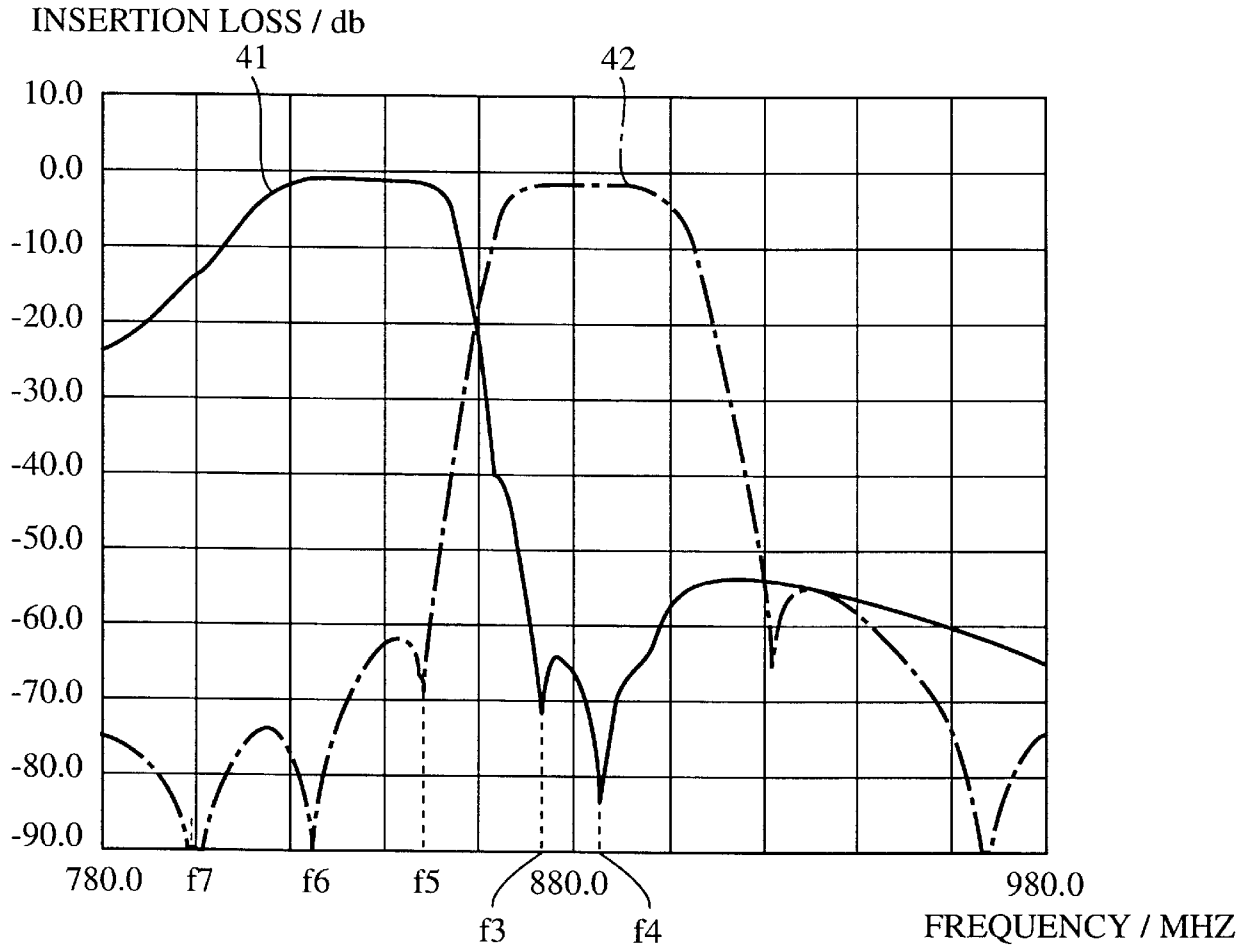
FIG. 13 is a graph illustrating the insertion loss versus frequency characteristic of the dielectric filter according to the third embodiment of the invention.

FIG. 13 is a graph illustrating the insertion loss versus frequency characteristic of the filter according to the third embodiment.

In FIG. 13, a curve 41 represents the insertion loss of the transmitting filter made up of the resonant through-holes 32*a*–32*d*. As described above, the coupling among the resonant through-holes 32*a*–32*d* is weakened by the slits 381–386 formed on the side faces 341 and 343 so that they are coupled with each other in an inductive fashion. As a result, two attenuation poles appear at different frequencies f3 and f4 higher than the passband. On the other hand, a curve 42 represents the insertion loss of the receiving filter made up of the resonant through-holes 32*e*–32*i*. Because there are no slits in the region where the resonant through-holes 32*e*–32*i* are located, these resonant through-holes are capacitively coupled. As a result, three attenuation poles appear at different frequencies f5–f7 lower than the passband.

Although in the present embodiment, the slits 381–386 are formed only in the transmitting filter region where the resonant through-holes 32*a*–32*d* are located, slits may also be formed in the receiving filter region so as to reduce the coupling among the large-diameter holes 321*e*–321*i* of the resonant through-holes 32*e*–32*i*. In the case where slits for reducing the coupling among the large-diameter holes 321*e*–321*i* are formed, the length of these slits may be equal to the length L31 of the slits 381–386. To achieve sufficient effects of the slits, it is preferable that the length of the slits corresponding to the large-diameter holes 321*e*–321*i* be equal to the length L32 of the large-diameter holes 321*e*–321*i*.

Figure 14A:
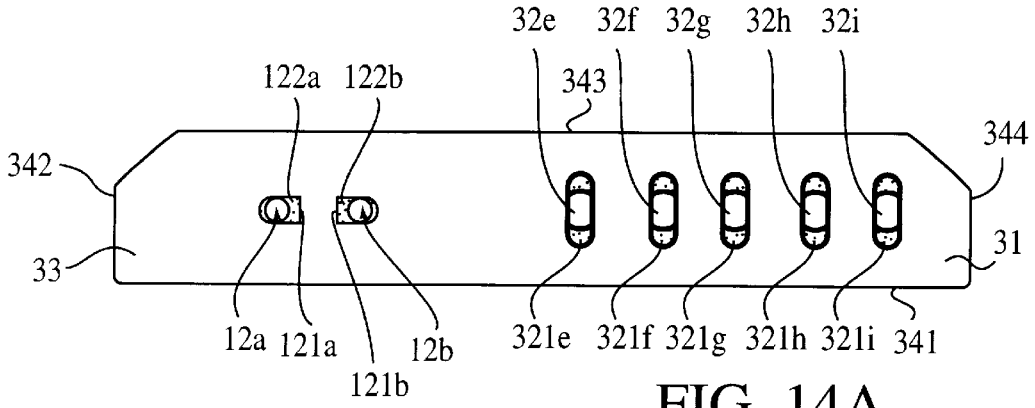
FIG. 14A is a schematic diagram illustrating the structure of a dielectric duplexer according to a fourth embodiment of the present invention, seen from its open-circuited end face.
Figure 14B:
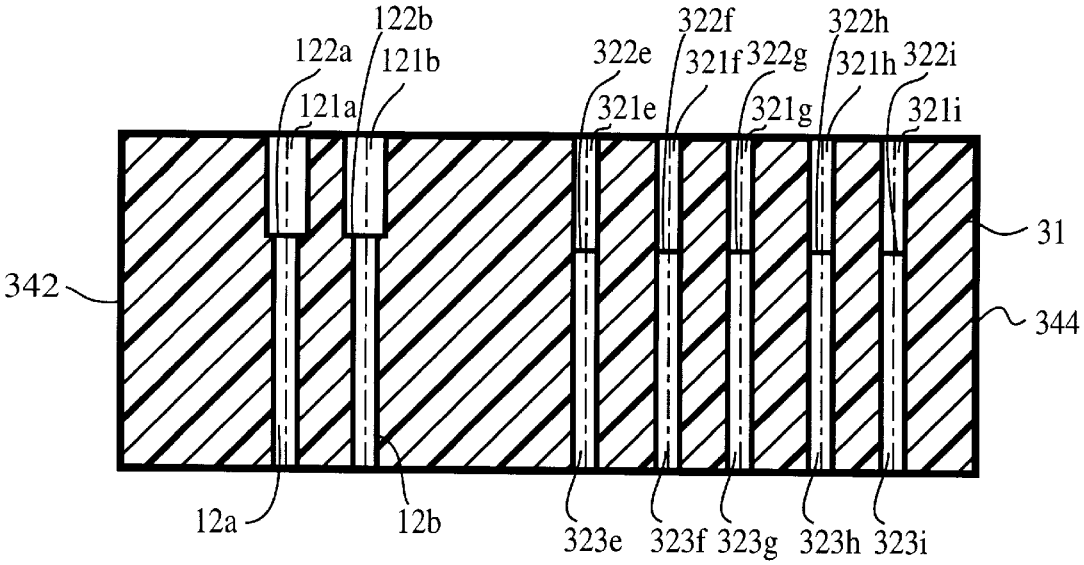
FIG. 14B is a longitudinal cross-sectional view of the dielectric filter.
Figure 14C:
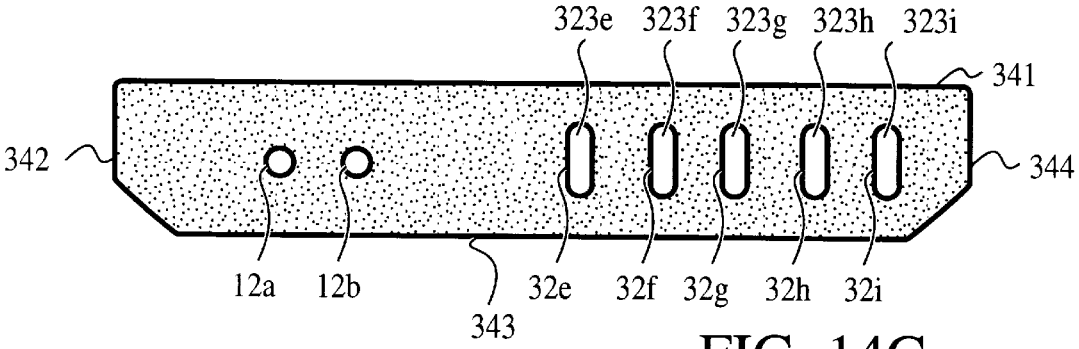
FIG. 14C illustrates the dielectric filter as seen from its short-circuited end face.
Figure 15A:
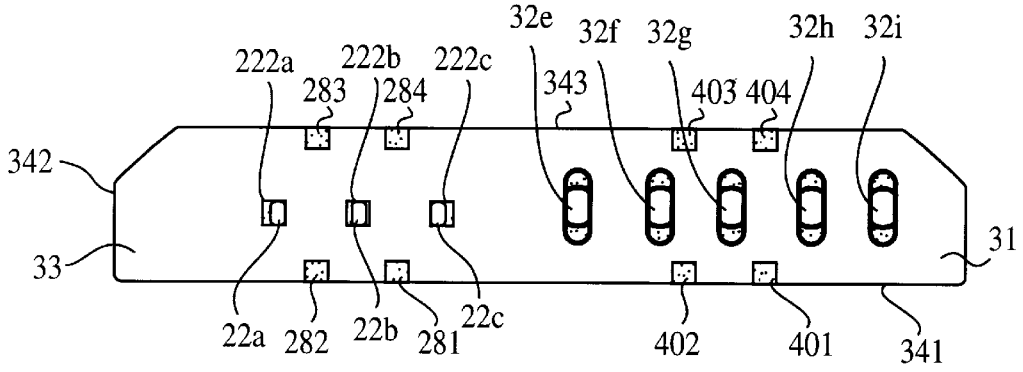
FIG. 15A is a schematic diagram illustrating the structure of a dielectric duplexer according to a fifth embodiment of the present invention, seen from its open-circuited end face.
Figure 15B:
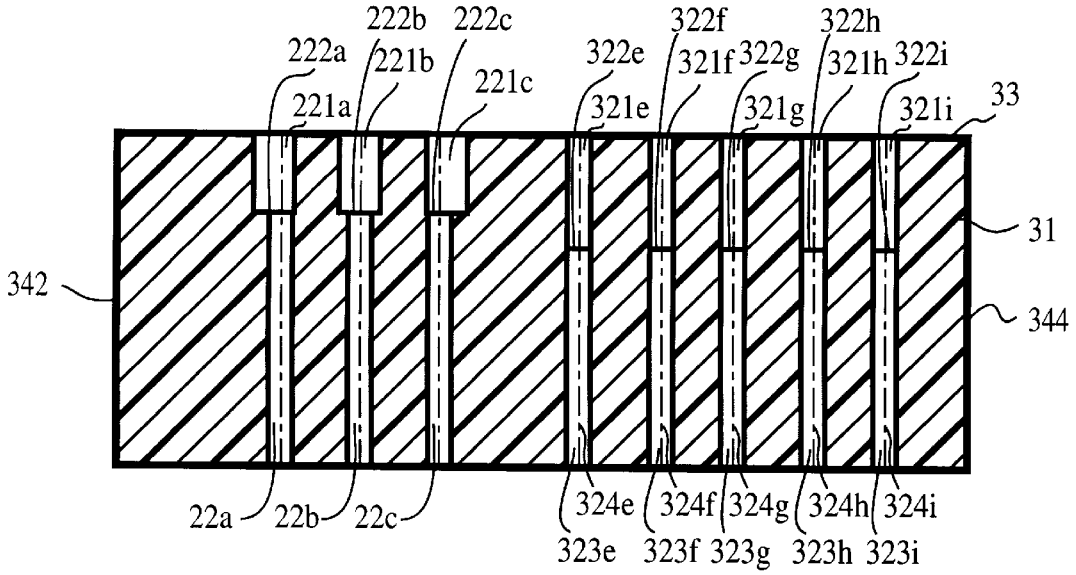
FIG. 15B is a longitudinal cross-sectional view of the dielectric filter.
Figure 15C:
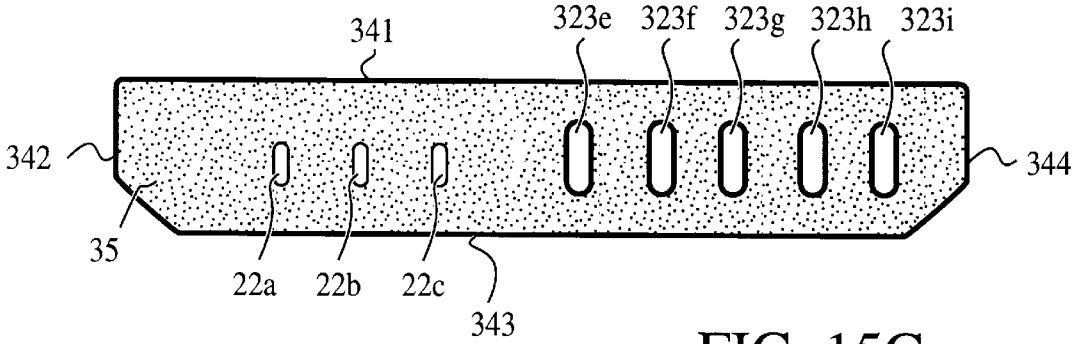
FIG. 15C illustrates the dielectric filter as seen from its short-circuited end face.

FIG. 14A is a schematic diagram illustrating the structure of a dielectric duplexer according to a fourth embodiment of the present invention, seen from its open-circuited end face, FIG. 14B is a longitudinal cross-sectional view of the dielectric filter, and FIG. 14C illustrates the dielectric filter as seen from its short-circuited end face; and FIG. 15A is a schematic diagram illustrating the structure of a dielectric duplexer according to a fifth embodiment of the present invention, seen from its open-circuited end face, FIG. 15B is a longitudinal cross-sectional view of the dielectric filter, and FIG. 15C illustrates the dielectric filter as seen from its short-circuited end face.

In FIGS. 14A–15C, the resonant through-holes 32*e*–32*i* are identical to those shown and described in connection with FIGS. 11A–12B.

In FIGS. 14A–14C, the resonant through-holes 12*a* and 12*b* are identical to those shown and described in connection with FIGS. 1A–1C. In FIGS. 15A–15C, the resonant through-holes 22*a*–22*c* and the slits 281–284 are identical to those shown and described in connection with FIGS. 6A–6C. In order to avoid redundant description, further details of the resonant through-holes 12*a*, 12*b*, 22*a*–22*c* and 32*e*–32*i* and the slits 281–284 are not necessary.

In the fourth embodiment, the resonant through-holes 12*a* and 12*b* form a first dielectric filter and the resonant through-holes 32*e*–32*i* form a second dielectric filter. In the fifth embodiment the resonant through holes 22*a*–22*c* form a first dielectric filter and the resonant through-holes 32*e*–32*i* form a second dielectric filter. In each embodiment, one of the first and second filters is usable as a transmitting filter and the other is usable as a receiving filter. Also in each embodiment, the distance in the first filter, from the top end surface 33 to the steps between the large-diameter holes and the small-diameter holes, is different from that in the second filter. Likewise, lengths of the slits are different in the first and second filters.

FIG. 15A also shows slits 401, 402, 403 and 404, each disposed between an adjacent pair of resonant through-holes in the second dielectric filter. The slits 401–404 are optionally provided, as described above in connection with FIG. 11A, in order to reduce the coupling among the large-diameter holes 322*f*, 322*g* and 322*h* of the resonant through-holes 32*f*, 32*g* and 32*h*.

Although embodiments of the invention have been disclosed herein, it is understood that the invention is not limited to such embodiments, but rather extends to such modifications, variations and equivalents of the disclosure that would occur to those having the ordinary level of skill in the pertinent art.

What is claimed is:

1. A dielectric filter comprising:

a plurality of resonant through-holes formed in a dielectric block, each resonant through-hole comprising a large-diameter hole and a small-diameter hole, a step being formed at a boundary between said large-diameter hole and said small-diameter hole, a wall of each said resonant through-hole being covered with an inner conductor;

an outer conductor formed on outer surfaces of said dielectric blocks, except for an end surface in which ends of the respective large-diameter holes are located; and input/output electrodes located on a surface parallel to a plane in which said resonant through-holes lie, said input/output electrodes being coupled with said large-diameter holes;

said dielectric filter being characterized in that center axes of said large-diameter holes are deviated from center axes of the corresponding small-diameter holes; and at least a pair of said large-diameter holes each have a generally rectangular shape in a cross-section taken perpendicular to the center axis of the hole, wherein one short side of the generally rectangular shape is rounded and the other short side is substantially straight.

2. A dielectric filter according to claim 1, wherein the distance from each said step to the end surface where ends of the respective large-diameter holes are located is set within a range of 1/16 to 1/4 of the length of each said resonant through-hole.

3. A dielectric filter comprising:

a plurality of resonant through-holes formed in a dielectric block, each resonant through-hole comprising a large-diameter hole and a small-diameter hole, a step being formed at a boundary between said large-diameter hole and said small-diameter hole, a wall of each said resonant through-hole being covered with an inner conductor;

wherein center axes of said large-diameter holes and center axes of the corresponding small-diameter holes are deviated from each other; and at least a pair of said large-diameter holes each have a generally rectangular shape in a cross-section taken perpendicular to the center axis of the hole, wherein one short side of the generally rectangular shape is rounded and the other short side is substantially straight;

an outer conductor formed on outer surfaces of said dielectric block except for an end surface in which ends of the respective resonant through-holes are located;

said dielectric filter being characterized in that:

a slit is formed on an outer surface parallel to a plane in which said resonant through-holes lie so that said slit is located at a substantially central position between an adjacent pair of said resonant through-holes; and a wall of said slit is covered with a slit conductor connected to said outer conductor.

4. A dielectric filter according to claim 3, wherein the distance from each said step to the end surface in which ends of said resonant through-holes are located is set to a value within a range of 1/16 to 1/4 of the length of each said resonant through-hole.

5. A dielectric filter according to claim 4, wherein the length of said slit is set to a value within a range of 1/16 to 1/4 of the length of said resonant through-holes.

6. A dielectric filter according to claim 3, wherein the length of said slit is set to a value within a range of 1/16 to 1/4 of the length of said resonant through-holes.

7. A dielectric filter according to any one of claims 3, 4, 5 and 6, wherein the distance between said end surface and said steps is substantially equal to the length of said slit.

8. A dielectric filter according to any one of claims 1, 2, 3, 4, 5 and 6, wherein said dielectric filter is a first filter included in a duplexer, and further comprising a second dielectric filter also included in said duplexer, one of said first and second dielectric filters being a transmitting filter and the other of said first and second dielectric filters being a receiving filter.

9. A dielectric filter according to claim 8, wherein the distance from said end surface to said steps in the transmitting filter is different from that in the receiving filter.

10. A dielectric filter according to claim 9, wherein said second dielectric filter has an outer conductor and a plurality of resonant through-holes, a slit being formed on an outer surface thereof parallel to a plane of said resonant through-holes and at a substantially central position between an adjacent pair of said resonant through-holes, a wall of said slit being covered with a slit conductor which is connected to said outer conductor; and the length of the slit in the transmitting filter is different from the length of the slit in the receiving filter.

11. A dielectric filter according to claim 8, wherein said second dielectric filter has an outer conductor and a plurality of resonant through-holes, a slit being formed on an outer surface thereof parallel to a plane of said resonant through-holes and at a substantially central position between an adjacent pair of said resonant through-holes, a wall of said slit being covered with a slit conductor which is connected to said outer conductor; and the length of the slit in the transmitting filter is different from the length of the slit in the receiving filter.

12. A dielectric filter according to claim 3, wherein a depth of said slit in a direction perpendicular to said plane in which said resonant through holes lie is set to a value of substantially 1/4 of the thickness of said dielectric block in said direction.

13. A dielectric filter according to claim 7, wherein said dielectric filter is a first filter included in a duplexer, and further comprising a second dielectric filter also included in said duplexer, one of said first and second dielectric filters being a transmitting filter and the other of said first and second dielectric filters being a receiving filter.

14. A dielectric filter according to claim 1, wherein said substantially straight short sides of said pair of large-diameter holes are opposed to each other so as to enhance mutual capacitance between said holes, and said rounded short sides of said pair of large-diameter holes are directed away from each other and are rounded so as to reduce self-capacitance of said holes.

15. A dielectric filter according to claim 14, wherein the long sides of the generally rectangular shape are substantially straight and are opposed to said input/output electrodes for coupling said input/output electrodes to said large-diameter holes.

16. A dielectric filter according to claim 3, wherein said substantially straight short sides of said pair of large-diameter holes are directed away from each other and are substantially straight so as to provide enhanced self-capacitance of said holes, and said rounded short sides of said pair of large-diameter holes are opposed to each other so as to reduce mutual capacitance between said holes.

17. A dielectric filter according to claim 16, wherein the long sides of the generally rectangular shape are substantially straight and are opposed to said input/output electrodes for coupling said input/output electrodes to said large-diameter holes.

* * * * *